United States Patent [19]

Lambot

[11] Patent Number: 4,986,035

[45] Date of Patent: Jan. 22, 1991

[54] GRINDING WHEEL FOR THE SMOOTHING AND POLISHING OF GLASSES

[75] Inventor: Honoré J. Lambot, Wauthier-Braine, Belgium

[73] Assignee: Diamant Boart Societe Anonyme, Brussels, Belgium

[21] Appl. No.: 318,530

[22] Filed: Mar. 3, 1989

Related U.S. Application Data

[63] Continuation of Ser. No. 149,997, Jan. 27, 1988, abandoned, which is a continuation of Ser. No. 831,690, Feb. 21, 1986, abandoned.

[30] Foreign Application Priority Data

Feb. 28, 1985 [BE] Belgium ..... 214578

[51] Int. Cl.[5] ..... B24B 9/12

[52] U.S. Cl. ..... 51/109 R; 51/209 R; 51/283 R

[58] Field of Search ..... 51/129, 131.1, 209 R, 51/109 R, 209 DL, 227 R, 283 E, 283 R

[56] References Cited

U.S. PATENT DOCUMENTS

| | | | |
|---|---|---|---|
| 1,707,162 | 3/1929 | Hudspith | 51/209 R X |
| 2,451,295 | 10/1948 | Metzger et al. | 51/209 R |
| 2,508,042 | 5/1950 | Rehnberg | 51/209 R X |
| 2,997,820 | 8/1961 | Skoog | 51/209 R |

FOREIGN PATENT DOCUMENTS 3201825 7/1983 Fed. Rep. of Germany .

*Primary Examiner*—D. S. Meislin

*Attorney, Agent, or Firm*—Sughrue, Mion, Zinn, Macpeak & Seas

[57] ABSTRACT

An abrasive grinding wheel having an inclined edge is obtained by subjecting an abrasive disc composed of spring steel sheet, preferably after flat grinding of the abrasive face, to stamping or turning followed by flat grinding. A grinding wheel of this type allows the capacity of a cutting off, smoothing, edge planing and polishing machine with automatic charging to be increased considerably.

2 Claims, 4 Drawing Sheets

FIG. 2
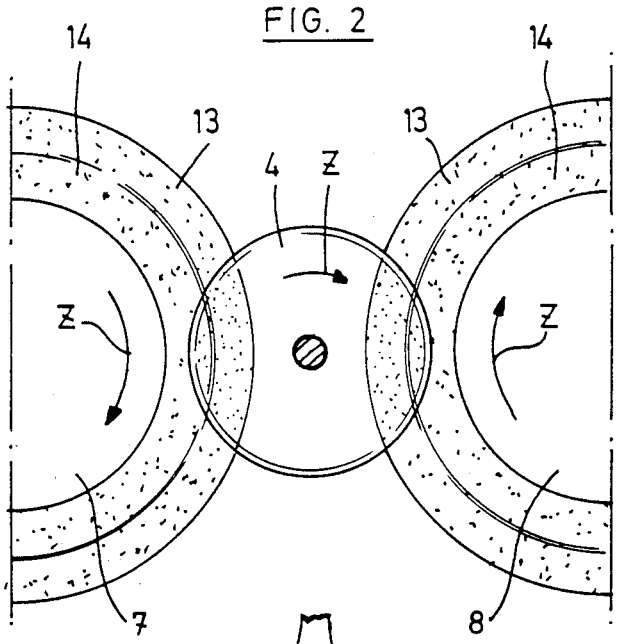
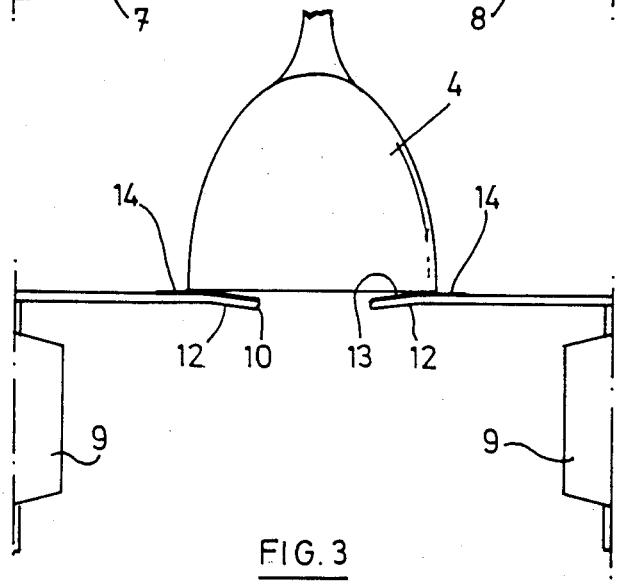
FIG. 3

GRINDING WHEEL FOR THE SMOOTHING AND POLISHING OF GLASSES

This is a continuation of application No. 07/149,997 filed Jan. 27, 1988, which is a continuation of application No. 06/831,690, filed Feb. 21, 1986 both now abandoned.

BACKGROUND OF THE INVENTION

This invention relates to a grinding wheel for smoothing the rim of a glass by means of a machine which cuts off the end, smoothes, planes the edge and polishes with automatic charging, comprising a rotary gripping head designed to grip the glass by its base and rotate it, means for applying this gripping head and this rotating glass to two grinding or polishing wheel elements which rotate in the opposite direction from the glass and are driven by floating motors which are at a fixed distance from one another and are arranged symmetrically and in secant fashion relative to the direction of application, these elements also being, in the free state, situated in a plane substantially perpendicular to this direction on the one hand, and slightly flexed by their contact with the rim of the glass along diametrically opposed portions of this rim, on the other hand, during the smoothing operation.

It is used mainly in machines for smoothing glasses.

The grinding or polishing element is formed by a rotating grinding wheel having a working surface perpendicular to its axis of rotation. The glass to be smoothed is placed by its rim in secant fashion against the abrasive surface of each of the grinding wheels so as to undergo grinding along two diametrically opposed arcs of contact. The glass is kept substantially vertical and is rotated about a vertical axis which is stationary during the smoothing operation.

Belgian Pat. No. 670,504 discloses a machine for smoothing or dressing the rims of glasses with automatic charging comprising a head for gripping a glass by its base, in particular by its foot, a means for setting the gripping head and the glass into rotation about the axis of the glass, a means for presenting this rotating gripping head to the above-mentioned grinding or polishing tool and for placing this rotating glass against this rotating tool. The tool is equipped with two flat grinding or polishing discs. These discs, which are abrasive and flexible, are at a fixed distance from one another. They are arranged symmetrically about the rotation axis of the glass placed on them. In the free state, they may be situated in the same plane a which is approximately perpendicular to this rotation axis, as shown in FIG. 4*a*. However, with such an arrangement, an irregularity 15 in the rim of the glass violently encounters the edge of the grinding wheel because of the relative trajectories of the glass and grinding wheels. The resulting impact causes a splinter or fracture in the rim. As shown in the enlarged view of FIG. 4*b*, irregularity 15 (shown in solid line) in the rim of an approaching rotating glass could be located below the level of grinding surface 14 and, thus, could impact or collide with the outer peripheral edge or wall of the grinding wheel. On the other hand, if irregularity 15 (shown in dotted line) of the approaching glass were to be vertically aligned with the flat grinding surface as the first point of contact with the surface of the grinding wheel, then abrading or grinding of the irregularity would start immediately.

Thus, to improve the angle of attack of the rim of

Thus, to improve the angle of attack of the rim of the glass, and as shown in FIG. 5 pairs of grinding wheels intended for the same glass axes advantageously inclined to one another and to the axes of rotation of the glass so that their axis of rotation were substantially convergent with the axis of symmetry of the glass. In other words, the two grinding wheels were placed in two different planes $\alpha$ and $\beta$ each forming a small angle (e.g. 30') with the plane containing the rim of the glass. To this end, the portion of the frame supporting a grinding wheel can be oriented relative to the glass-gripping head along the direction in which the glass is supplied to the grinding wheel.

The main drawback of the particular arrangement of the grinding elements in two different planes $\alpha$, $\beta$ inclined with regard to the rotating axis of the glass to be smoothed is the insufficient contact length between the rim of the glass and the flat portion of the grinding element, whereby the small contact arc of the rim of the glass prolongs the duration of the grinding operation.

In order to increase the contact pressure with the rim of the glass, each grinding or polishing disc is mounted on a rotating table of which the face receiving the disc is provided with a succession of plates of increasing diameter which are made of small thickness spring steel so as increasingly to rigidify the grinding wheel on approaching the axis. This configuration allows an abrasive power during smoothing to be predetermined while permitting a progressive increase in the rigidity of the grinding wheel and in the abrasiveness and in the grinding rate of the grinding wheel along the arc of contact between the rim of the glass and the grinding wheel.

Owing to the high frequency of rotation of the discs, the glasses are sensitive to a sudden accidental variation in the pressure due, for example, to irregularities in the cut off surface of the rim. At the speeds of rotation under consideration, even a minimal impact on a glass can cause the glass to break.

Belgian Patent of improvement No. 696,828 proposes that the rotating discs be mounted on floating motors of which the rotary shafts are subjected to a suitable constant pneumatic pressure for the duration of smoothing of the glass. Each motor shaft rests on a bead cylinder fixed on the housing of this motor. In the free state, the bead rests on the base of the cylinder and is raised from this seat during the smoothing operation under the influence of a compressed gas which provides the above-mentioned pneumatic pressure.

The use of flexible flat discs on floating motors allows a high smoothing yield, constancy in the quality of the smoothed glasses and a low breakage rate and good service life of the discs to be achieved. The productivity of an automatic cutting off-smoothing-edge planing-polishing machine having 24 working stations can thus reach up to 45 glasses per minute when the glasses are perfectly cut off.

SUMMARY OF THE INVENTION

The object of the present invention is to increase the capacity of such a machine without increasing the number of working stations. It proposes a grinding wheel which allows irregularly cut-off glasses to be smoothed correctly without breaking or flaking them. It also allows the grinding pressure to be increased substantially up to twice without the risk of the glass melting and consequently allows the rate of glass ground to be increased as a function of the pressure applied.

To this end, each grinding wheel intended for the smoothing and polishing of glasses is constituted by a rotating abrasive disc having a diameter of from 100 to 300 mm and being in the form of a dish-shaped spring steel sheet having a thickness of from 0.5 to 3 mm which is shaped by stamping or by turning followed by flat grinding.

Flat grinding of the diamond-charged face of the dish-shaped grinding wheel is relatively easy to carry out. In fact, this operation may be carried out when the disc is still flat since the abrasive disc may be subjected to stamping after flat grinding of the diamond-charged solid mass has been carried out.

According to a feature of the invention, the spring steel sheet is quenched and tempered so as to have a Rockwell hardness of between 40 and 50 $HR_c$ and, in particular, between 42 and 43 $HR_c$.

Further details and features of the invention will appear during the description of the drawings attached to this specification which illustrate an embodiment of the invention schematically and merely by way of example.

BRIEF DESCRIPTION OF THE DRAWINGS

FIG. 2 is a plan view of a smoothing station employing truncated cone shaped grinding wheels according to the invention.

FIG. 3 is an axial section similar to the one in FIG. 1 of the profile of the edge of a grinding wheel on an enlarged scale.

DETAILED DESCRIPTION OF THE PREFERRED EMBODIMENTS

Figure 1:
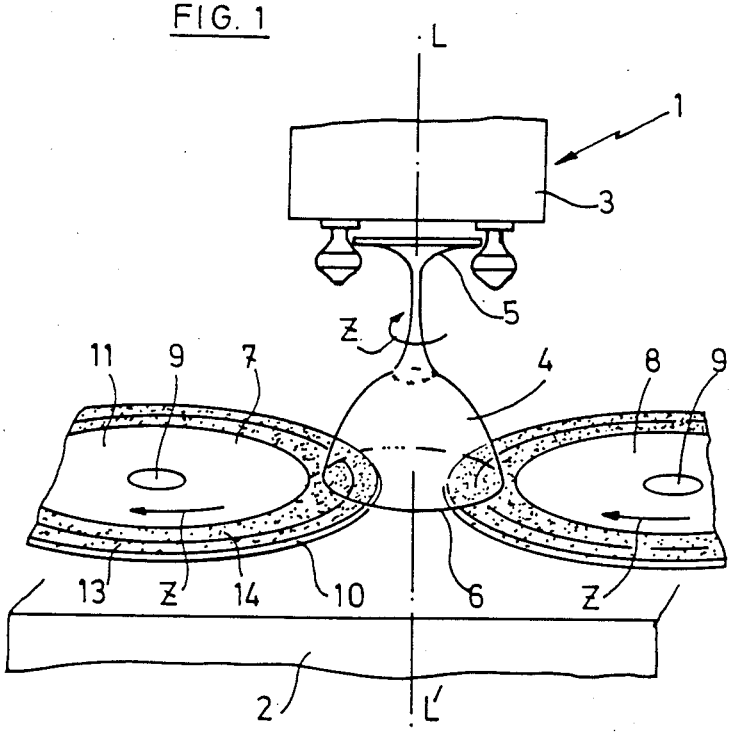
FIG. 1 is a perspective view of a smoothing device showing a gripping head, a glass and a pair of grinding wheels with abrasive working surfaces.

In these three figures, the same reference numerals designate identical or similar elements.

As shown in FIG. 1, a smoothing device designated overall by the reference numeral 1 comprises a frame 2 on which there is mounted at least one rotating gripping head 3 constituted by a gripping chuck allowing a glass or tumbler to be aligned along an axis of symmetry.

The glass 4 or the tumbler gripped by its foot 5 or by its base in the gripping chuck is set into rotation about a common vertical axis L,L'. The rim 6 of the glass 4 set into rotation is placed in secant manner by two diametrically opposed arcs of its rim symmetrically on the outer marginal region of a pair of grinding wheels 7,8 which are set into rotation by floating motors 9, as described in Belgian Pat. Nos. 670,504 and 696,828.

To allow an improved abrasive power to be applied to a pair of rotating discs 7, 8 acting on the rim of the same glass 4 to be smoothed, the two discs 7 and 8 as well as the glass 4 arranged in secant fashion on the two discs 7 and 8 are rotated in the same direction of rotation Z, which is a clockwise direction in the case illustrated in FIG. 1.

In substance, a grinding wheel 7, 8 according to the invention comprises an annular disc formed by a flat sheet 10 of spring steel having a thickness of between 1.0 and 1.5 mm and preferably of 1.2 mm.

After being cut out and cut to size, the sheet 10 is firstly treated thermally and is then flat ground on the two faces 11 and 12. The thermal treatment imparts to the sheet 10 a Rockwell hardness of between 40 and 50 $HR_c$ which enables it to resist the stresses applied to it during smoothing and polishing and in particular to resist the bending stresses, without being excessively deformed.

The Rockwell hardness merely gives an idea of the elasticity of the sheet metal used. This sheet is advantageously composed of a spring steel according to AISI standard 1095 and mentioned by way of example. It may also be produced from steel according to AFNOR standard XC 100.

According to the invention, an edge 13 which is or inclined to the surface of the central working zone 14 of the disc 7,8 is made in the rotating disc 7,8 by stamping, this edge 13 being inclined in a direction opposed to that towards which the face 11 bearing the abrasive mass is presented.

Figure 3A:
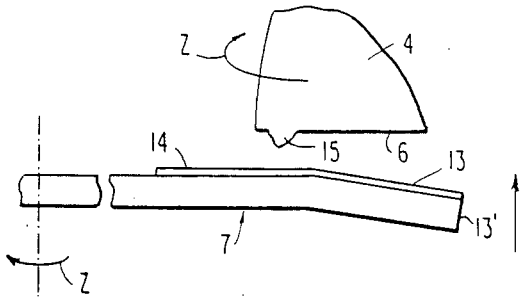
FIG. 3*a* is an enlarged fragmentary cross-sectional view taken along line 3*a*—3*a* of FIG. 2 and shows operating conditions as the rim of a glass first approaches the surface of a grinding wheel.

The angle of inclination of the widened peripheral edge 13 is relatively small but sufficient considerably to improve the gradual access of the rim 6 of the glass 4 to be smoothed on the grinding wheel so that there is no violent impact between the irregularity 15 and the grinding wheel (FIG. 3*a*).

The obliqueness of the truncated cone shaped or dish-shaped edge of the stamped disc also has the effect of increasing the rigidity of the sheet metal 10.

In a particular embodiment illustrated in FIG. 3, the inclination of the edge 13 ranges from 0.5 to 1.5 mm over a radial distance of between 5 and 15 mm, in particular from 0.7 to 0.8 mm over a radial distance of 7.5 mm.

The flat surface of the central zone 14 allows the rim of the glass 4 to be treated at a much higher rate than that achieved up until now in the machines known at present.

Under the influence of the slight smoothing thrust exerted by the glass 4 against the grinding wheel 7,8, the shaft of the pneumatically tensioned floating motor 9 absorbs the impact and progressively retracts under constant pressure until it reaches the end of its travel.

As the pressure of the rim 6 of the glass on the grinding wheel 7,8 is kept constant while the smoothing operation is considered still to be unfinished, a progressive deformation of the grinding wheel 7,8, which flexes slightly in the direction of the pressure of the glass, is created during the second portion of the smoothing operation.

In fact, it is the flexibility of the grinding disc 7,8 which alone takes up the pressure exerted by the glass 4 on the disc 7,8.

Figure 3B:
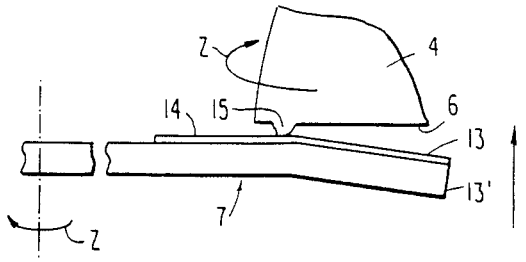
FIGS. 3*b* and 3*c* are explanatory views similar to FIG. 3*a* and respectively show two possible operating conditions as the rim is lowered onto a grinding wheel.
Figure 3C:
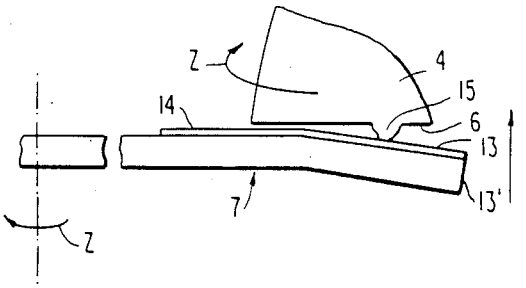
Figure 4A:
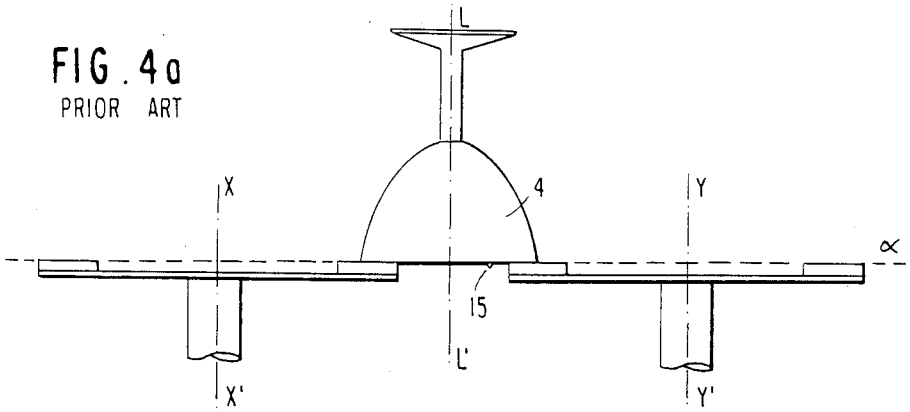
FIG. 4a PRIOR ART
FIGS. 4*a*, 4*b* and 5 illustrate prior art glass grinding wheels and machines.
Figure 4B:
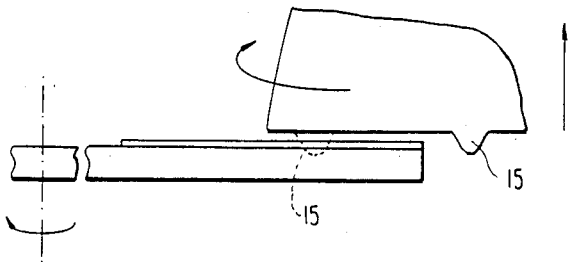
FIG. 4b PRIOR ART
Figure 5:
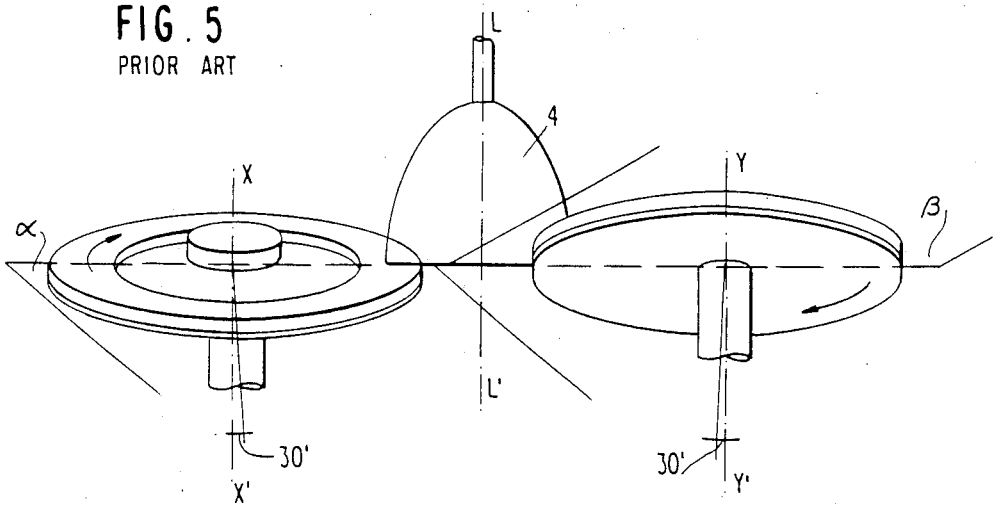
FIG. 5 PRIOR ART

The importance of rigidifying the grinding wheel by a succession of plates of increasing diameter in the central zone and of maintaining flexibility in the peripheral zone, as shown by the prior art discussed above, can thus be seen. The present invention allows this object to be achieved. It also allows the gradual and gentle access or entry of the rim 6 onto the grinding wheel to be improved because of the convex shape of the wheel. It allows progressive grinding of the glass and eliminates the probability of violent impacts between the rim 6 (and on irregularity 15) of the glasses 4 and the grinding wheels 7,8. The enlarged fragmentary cross-sectional view of FIG. 3*a* shows the rim 5 of the rotating glass 4 approaching the upper surface of the rotating disk 7 in the condition where a downwardly projecting irregularity 15 of the rough or unsmooth rim 15 is vertically aligned with the flat, horizontal central abrasive zone 14, in which case grinding down of the irregularity 15 is effected by the central zone 14 as shown in FIG. 3*b*. However, if the rotating glass should approach the rotating disk 17 with the same irregularity vertically aligned with the inclined abrasive portion 13, then the irregularity 15 will be progressively ground as it rides up the inclined portion 13 onto the flat central portion 14 by virtue of the rotation of the glass; however, because of the downward inclination of the portion 13, neither the rim nor the irregularity 15 will impact or collide with the outer peripheral edge or wall 13' of the inclined portion 13 as shown in FIG. 3*c*; furthermore, in this condition, of course, the rim portion vertically aligned with the central flat abrasive zone will be engaged and smoothed thereby.

Since the grinding wheels 7,8 according to the invention can be mounted in pairs and flat in the same smoothing plane, the abrasive surface in contact with the rim of the glasses 4 is defined by arcs of diametrically opposed circles and is greater than in known smoothing devices while allowing excellent entry. Moreover, the contact surface may be adjusted at will by modifying the distance between the grinding wheels depending on the diameter of the glasses to be smoothed. A variable interval between the discs also allows a greater proportion of the abrasive surface to be used so as to obtain uniform wear of the entire available active surface of the grinding wheel.

It is obvious that the invention is not limited exclusively to the embodiments illustrated and that several modifications can be made to the form, the constitution and the arrangement of certain elements used in its production providing that these modifications are not in contradiction with the subject of each of the following claims.

What is claimed is:

1. In a machine for cracking-off, smoothing, bevelling and polishing the rim of a glass, comprising an upper rotatable gripping head (3) for gripping the glass (4) by its base (5), setting it into rotation about a vertical rotation axis, and urging it in a direction parallel to the rotational axis of the glass so that its rim (6) bears against the upper surface of each of two grinding wheels which are rotatable by floating motors (9), said wheels being horizontally spaced apart from one another by a fixed distance, said wheels also being arranged symmetrically and in secant fashion in respect to the direction of application of a rim of said glass (4) onto said grinding wheels, the improvement wherein:

said grinding wheels (7, 8) are dish-shaped abrasive disks disposed in a common horizontal plane substantially perpendicular to said direction;

each grinding wheel is an abrasive disk of a diameter of 100 to 300 mm and is constituted by a dish-shaped spring steel sheet (10) having a thickness of 0.5 to 3 mm, each disk having a downwardly inclined outer peripheral annular edge portion (13) having an imperforate continuous surface and an inwardly adjacent annular horizontal flat central portion (14) having an imperforate continuous surface, thereby avoiding a horizontal collision between (a) an outer edge of each disk and (b) the rim which is being applied onto said upper surface of the disk and which contains irregularities; and the inclination of the edge portion (13) ranges from 0.5 to 1.5 mm over a radial distance of between 5 and 15 mm.

2. Machine according to claim 1, wherein said inclination ranges from 0.7 to 0.8 mm and said radial distance is 7.5 mm.

* * * * *